United States Patent [19]

Gesser et al.

[11] 4,320,847

[45] Mar. 23, 1982

[54] CONTAINER FOR RECEIVING AND STORING SPENT FUEL ELEMENTS

[76] Inventors: Gernot Gesser, Ludwigstrasse 157, 6450 Hanau 7; Franz Hauer, Hofer-Weg 44, 6367 Karben 6; Berthold Racky, Johannesweg 7, 6369 Nidderau 1; Dieter Klein, Heinrich-Heine-Strasse 9, 6036 Friedberg, all of Fed. Rep. of Germany

[21] Appl. No.: 169,108

[22] Filed: Jul. 15, 1980

[30] Foreign Application Priority Data

Jul. 31, 1979 [DE] Fed. Rep. of Germany ..... 2930991

[51] Int. Cl.[3] ..... B65D 6/34; B65D 8/04; B65D 8/06

[52] U.S. Cl. ..... 220/67; 220/352

[58] Field of Search ..... 220/3, 67, 359, 352; 138/89

[56] References Cited

U.S. PATENT DOCUMENTS 1,853,112 4/1932 Boltz ..... 220/67 X 2,480,376 8/1949 Martin ..... 220/67 X

*Primary Examiner*—George T. Hall

*Attorney, Agent, or Firm*—Cushman, Darby & Cushman

[57] ABSTRACT

For the storage of spent fuel elements there are needed containers consisting of can and cover which undergo a preliminary sealing in inserting the cover, produce a uniform weld gap, are not jammed in opening and are repeatedly reusable. Such containers are obtained if the cans have a frusto conical widening at the upper end and the cover likewise has a frusto conical region in which there is formed between the two conical regions an acute angle of preferably 1°–7°.

4 Claims, 1 Drawing Figure

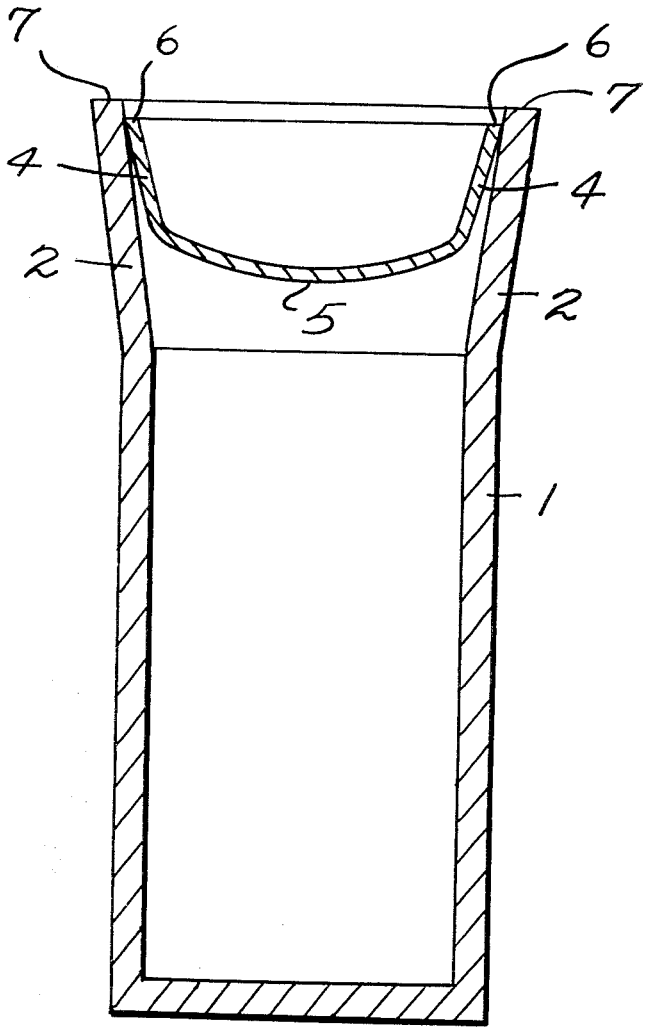
7
6
6
7
4
4
2
2
5
1

CONTAINER FOR RECEIVING AND STORING SPENT FUEL ELEMENTS

BACKGROUND OF THE INVENTION

The object of the invention is the development of a container for receiving and storing spent fuel elements consisting a metal box and a cover curved inwardly and provided with a torispherical head.

Spent fuel elements from nuclear reactors are first stored in decay tanks at the reactor and then stored intermediately until further reprocessing. The intermediate storage takes place in wet storage tanks under water or in dry storage under air coolings. For this purpose the spent fuel elements are placed for example in 5 to 6 meters long, can-like metal containers, in a given case fixed in place and shielded by filling in with lead, and closed with a cover. The tightly closed boxes are subsequently brought into the intermediate storage position.

Normally these metal cans or boxes consist of alloy steel with the required strength and corrosion properties and have a perfectly cylindrical or rectangular shape in which there is frequently welded an inwardly curved cover. This type of closure however, for the most part causes a non-uniform gap between cover and container rim or edge and therewith creates difficulties in the welding. Besides in mechanically inserting the cover there is not obtained sufficient preliminary sealing of the container's contents against the surroundings. Furthermore in the closing and later opening of the cover there can occur corrosion phenomena since unevennesses at the inner rims of the cover and container are not excluded.

There are also known storage containers in which the cover is screwed on and provided with a synthetic resin or metal seal.

Therefore it was the problem of the present invention to construct a container for receiving and storing fuel elements consisting essentially of a metal box and an inwardly curved cover provided with a torispherical head, which in the mechanical application of the cover causes a preliminary sealing of the contents of the container, in welding the cover with the box produces a uniform welding gap, does not show any corrosion phenomena in opening the cover and is repeatedly reusable.

SUMMARY OF THE INVENTION

This problem was solved according to the invention by having the can or box possess a frusto conical widening at its upper end and the cover above the torispherical head likewise possessing a frusto conical region in which there is formed between the two conical regions at the point of contact an acute angle. Preferably this acute angle between the conical widening of the box and the conical region of the cover is 1°–7°, in which case the conical widening of the can preferably forms an angle of 3° to 10° to the surface line of the can.

BRIEF DESCRIPTION OF THE DRAWING

The single FIGURE schematically illustrates one form of the container of the invention.

The container of the invention can comprise, consist essentially of or consist of the stated elements.

DESCRIPTION OF THE PREFERRED EMBODIMENTS

The container consists of a can 1, for example a cylindrical tube having a wall thickness of 4 to 8 mm which has a frusto conical widening 2 at the upper end. This conical widening or enlargement 2 forms an angle ($\beta$) to the extension of the surface line of the can 1 of preferably 3°–10° and advantageously has a length of 50–150 mm. There is pressed into the conical widening 2 of the can 1 an inwardly curved cover 3 having a torisphericalhead 5 which above the bottom 5 likewise exhibits a frusto conical region 4 whose angle to the surface line of the box 1 is greater than the angle of the conical widening 2 to this surface line. Preferably the angle is around 1°–7° greater which means the angle ($\alpha$) between the conical widening 2 of the box 1 and the conical region 4 of the cover 3 likewise is preferably 1°–7°. The conical region 4 of the cover 3 advantageously has a diameter such that the cover rim or edge 6 in the applied position lies 1–10 mm below the upper can rim or edge 7. Of course the cover rim 6 can also lie above the upper can rim 7. Cover 3 and can 1 then are normally closed with a welding seam.

This construction of the invention has the advantage that the cover 3 can be inserted into the can 1 without the necessity of there being present a support on the inner side of the can and in which the inner free cross-section of the can would be narrowed down. Since the contact and support of cover 3 and can 1 takes place in the conical region only on a very narrow peripheral zone there is reliably avoided a "corrosion" or cold welding of the two parts in the mechanical insertion of the cover 3 so that a later opening of the welded can can take place without problem after removal of the rim weld. Already in the light pressing of the cover 3 in the can 1 there occurs through the conical configuration such a preliminary sealing that in the later welding there is no escape through the liquid welding seam and as a result formation of pores in the welding seam or the releasing of activity because of the excess pressure developed by the heat of welding.

In the automatic welding, e.g. in a hot cell there is guaranteed an exact guiding edge for the welding apparatus because of the advantageous projecting length of the rim 7 of the can or the rim 6 of the cover, whereby the required material for formation of the welding seam advantageously is melted from the projecting edge without there occurring an attenuation of the wall cross-section in the region of the welding seam. Through the conical regions of the can 1 and cover 2 with different steep sides below the contact zone there is formed an only minimal, uniform gap, through which there can be attained a very strong, reliable welding seam.

Furthermore, the container of the invention has the advantage that after removal of the welding seam by milling, turning or by sawing the can and cover can be reused repeatedly while maintaining the favorable shape of the welding seam.

The container of the invention naturally is also usable for the storage of other bioinjurious waste and can also serve for the transportation of such material, in a given case in combination with an additional shielding container or a shielding jacket.

There is incorporated by reference the entire disclosure of German priority application No. P 2930991.9.

What is claimed is:

1. A container adapted to receive and store spent fuel elements consisting essential of a metal can and an inwardly curved cover having a torispherical head, said can having a frusto conical widening region at the upper end thereof and the cover above the torispherical head also having a frusto conical region, there being formed between the two conical regions at the place of contact an acute angle ($\alpha$) of 1°–7°, the frusto conical widening of the can forming an angle ($\beta$) of 3°–10° to the extension of the surface of the line of the can.

2. A container according to claim 1 wherein the length of the conical widening of the can is 50–150 mm.

3. A container according to claim 2 wherein the frusto conical region of the cover has a diameter such that the cover rim in the applied condition is 1–10 mm below the upper rim of the can.

4. A container according to claim 1 wherein the frusto conical region of the cover has a diameter such that the cover rim in the applied condition is 1–10 mm below the upper rim of the can.

* * * * *